United States Patent [19]

Chabala et al.

[11] 3,965,452

[45] June 22, 1976

[54] EXHAUST CONTROL DEVICE FOR CIRCUIT INTERRUPTING DEVICES

[75] Inventors: Leonard V. Chabala, Maywood; Otto Meister, Arlington Heights, both of Ill.

[73] Assignee: S & C Electric Company, Chicago, Ill.

[22] Filed: Apr. 1, 1975

[21] Appl. No.: 564,075

[52] U.S. Cl. ..... 337/280; 337/281

[51] Int. Cl.[2] ..... H01H 85/38

[58] Field of Search ..... 337/276, 278, 279, 280, 337/281, 282

[56] References Cited

UNITED STATES PATENTS

| | | | |
|---|---|---|---|
| 2,056,189 | 10/1936 | Hill | 337/281 |
| 2,112,841 | 4/1938 | Hill | 337/281 |
| 2,393,584 | 1/1946 | Bennett | 337/279 X |
| 3,230,331 | 1/1966 | Lindell | 337/280 X |
| 3,719,912 | 3/1973 | Harner et al. | 337/280 |
| 3,827,011 | 7/1974 | Braunstein | 337/280 X |
| 3,898,602 | 8/1975 | Schurter | 337/280 X |

*Primary Examiner*—J D Miller
*Assistant Examiner*—Fred E. Bell
*Attorney, Agent, or Firm*—Kirkland & Ellis

[57] ABSTRACT

An exhaust control device to absorb the energy of exhaust gases released during operation of a circuit interrupting device such as a power fuse or an expulsion fuse is disclosed. The exhaust control device includes a housing mounted to the circuit interrupting device having an intake port for receiving the hot exhaust gases produced during and incident to the operation of the circuit interrupting device. A heat sink consisting of a mass of wire mesh is positioned within the housing and initially cools the exhaust gases. A gas flow diverting baffle is positioned within the housing to absorb additional energy by changing the direction of flow of the exhaust gases so that the metallic vapors and particles picked up by the exhaust gas flowing through the heat sink are condensed and deposited. The exhaust gas is then passed through particles of absorbent material such as activated alumina that further cools the gases and absorbs water vapor and metallic vapor from the exhaust gases. A labyrinth plate having labyrinth channels formed thereon is positioned over exhaust ports in the opposite end of the housing so that the exhaust gases flow through the labyrinth channels thereby repeatedly changing the direction of flow of the gases to absorb additional energy before the gases pass out of the exhaust ports into the atmosphere. The exhaust control device may also include a check valve for preventing the exhaust gases from reentering the circuit interrupting device after they have been received by the exhaust control device.

23 Claims, 17 Drawing Figures

FIG. 4
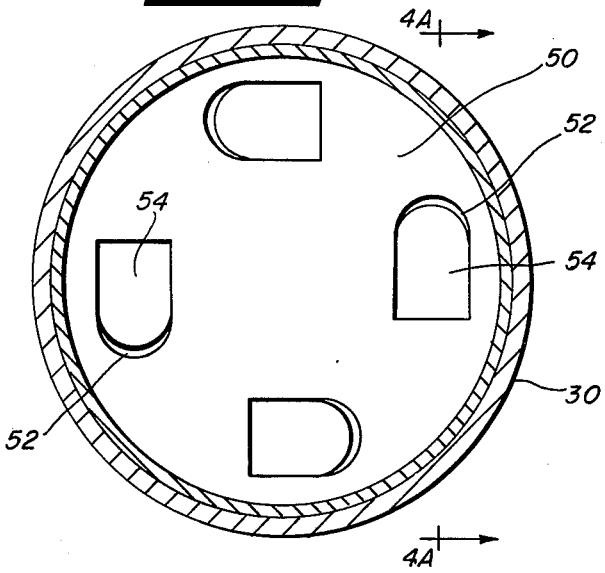
FIG. 4A
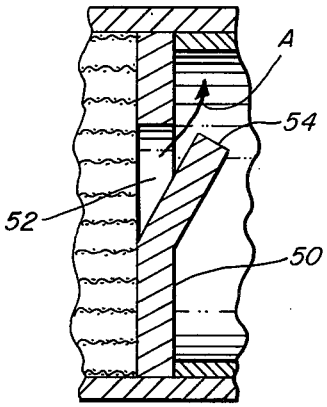
FIG. 4B
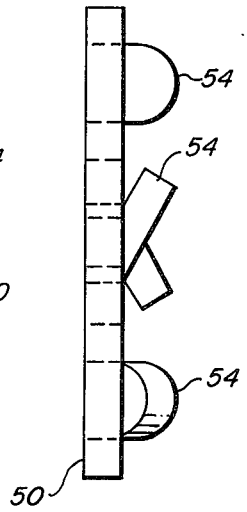
FIG. 5
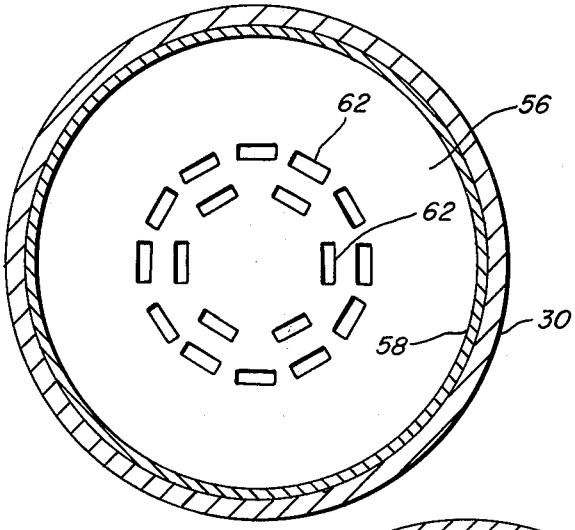
FIG. 6
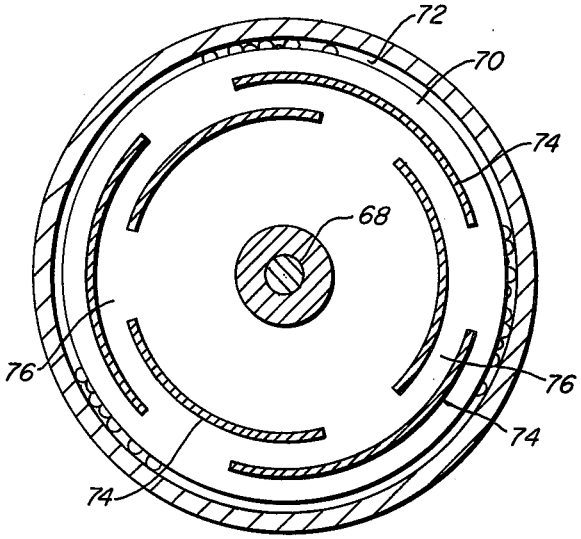
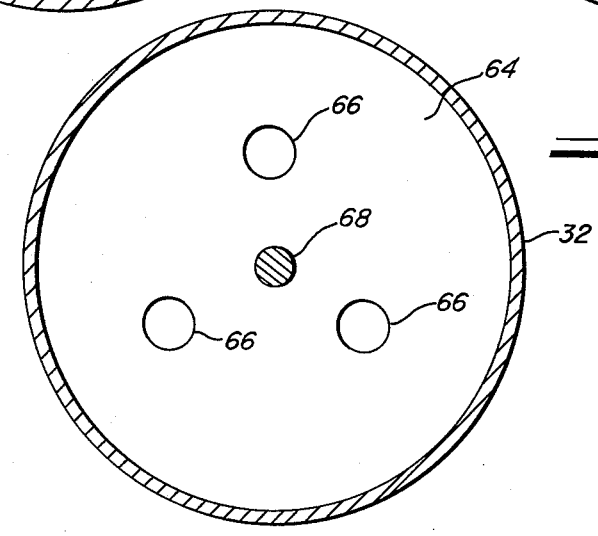
FIG. 7

12
100
102
110
104
112
115
106
114
109
117
108
116
107
118
126
130
130
120
122
128
124
132

EXHAUST CONTROL DEVICE FOR CIRCUIT INTERRUPTING DEVICES

BACKGROUND OF THE INVENTION

1. Field of the Invention

The present invention relates to exhaust control devices for high voltage circuit interrupting devices and more particularly, the present invention relates to exhaust control devices for high voltage electrical fuses.

2. Description of the Prior Art

The present invention constitutes an improvement over the construction disclosed in U.S. Pat. No. 3,719,912 - Harner et al., entitled Exhaust Control Device For Circuit Interrupting Devices, issued Mar. 6, 1973 and assigned to the same assignee as the present application.

It is well known in the art that it is desirable to prevent discharge into the atmosphere of the hot arc products and gases incident to the operation of a circuit interrupting device. It is also desirable to reduce the noise level incident to the operation of an expulsion fuse and to absorb substantially all of the energy of the arc products created during operation of such an expulsion fuse to prevent the hot arc products and metallic vapors from entering the atmosphere. Preferably, the exhaust control device must reduce sound level during operation and reduce the discharge of gases without significantly interfering with the intended function of the fuse. Moreover, it is a desirable advance in the art to provide such an exhaust control device that will perform such functions repeatedly without loss of effectiveness of the exhaust control device.

Thus, it would be a desirable advance in the art to provide an exhaust control device having less volume and constructed of smaller quantities of expensive materials without effecting the efficiency of the exhaust control device particularly when used repeatedly.

BRIEF SUMMARY OF THE INVENTION

An exhaust control device in accordance with the present invention for use on a circuit interrupting device comprises a hollow housing having an intake port for receiving a stream of hot exhaust gases incident to the operation of the circuit interrupter. Heat sink means is positioned in the housing adjacent the intake port in the stream of travel of the hot exhaust gases for initially cooling the hot exhaust gases. A votex-producing means is positioned downstream of the heat sink means for changing the direction of flow of the hot exhaust gases to achieve a momentum energy exchange to slow the speed of travel of the exhaust gases and to deposit and condense molten metal and metal vapor carried by the exhaust gases. Absorbent means is positioned within the housing downstream of the vortex-producing means for further cooling the hot exhaust gases and absorbing water vapor, attenuating sound, and filtering solid debris, molten metal, and metal vapor still carried by the hot exhaust gases. Labyrinth means is positioned downstream of the absorbent means for repeatedly changing the direction of flow of the exhaust gases and for further attenuating the sound. Outlet means are provided communicating with the labyrinth means for allowing the exhaust gas to except to the atmosphere.

The present invention may also include a check valve means for preventing the exhaust gases from re-entering the circuit interrupter after the exhaust gases are received by the exhaust control device. The check valve means avoids back flow of hot exhaust gases back into the circuit interrupter after interruption and reduces the possibility of the arc being re-established resulting in failure of the circuit interrupter to interrupt the current flow due to thermal breakdown of the dielectric path within the fuse.

Thus, it is a primary object of the present invention to provide an exhaust control device for a circuit interrupter having a smaller volume, smaller quantities of expensive materials, and improved silencing efficiency than prior art devices particularly when used repeatedly.

It is a further object of the present invention to provide an exhaust control device for a circuit interrupter than reduces the discharge into the atmosphere of the arc products formed during the operation of the circuit interrupter without reducing the effectiveness of the circuit interrupter in interrupting current flow.

A further object of the present invention is to provide an exhaust control device for a circuit interrupter that eliminates rapid venting of exhaust gases into the atmosphere while eliminating back-flow of the exhaust gases back into the circuit interrupter.

Another object of the present invention is to provide an exhaust control device for a circuit interrupter that cools high temperature exhaust gases incident to the operation of the circuit interrupter so that limited communication and exhaust of gas to the atmosphere is maintained during one or more operations of the exhaust control device.

These and other objects, advantages, and features shall hereinafter appear, and for the purposes of illustration, but not for limitation, exemplary embodiments of the present invention are illustrated in the accompanying drawings.

BRIEF DESCRIPTION OF THE DRAWINGS

FIG. 4 is a cross sectional view taken substantially along line 4—4 in FIG. 2.

FIG. 4A is a cross sectional view taken substantially along line 4A—4A in FIG. 4.

FIG. 4B is a side view of the baffle plate illustrated in FIG. 4.

FIG. 5 is a cross sectional view taken substantially along line 5—5 in FIG. 2.

FIG. 6 is a cross sectional view taken substantially along line 6—6 in FIG. 2.

FIG. 7 is a cross sectional view taken substantially along line 7—7 in FIG. 2.

DETAILED DESCRIPTION OF THE PREFERRED EMBODIMENTS

Figure 1:
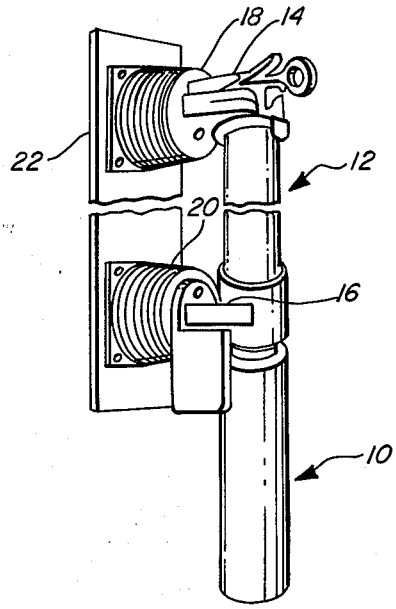
FIG. 1 is a partially fragmentary left perspective view of a high voltage fuse having an embodiment of an exhaust control device in accordance with the present invention attached thereto.

With reference to FIG. 1, exhaust control device 10 is attached to the base of high voltage fuse 12. Fuse 12 is of conventional design and is mounted between an upper terminal 14 and a lower terminal 16. Upper and lower terminals 14 and 16 are mounted on insulators 18 and 20, each of which is mounted on appropriate mounting structure 22. Upper terminal 14 is typically connected to a high voltage conductor (not shown), and similarly lower terminal 16 is connected to a high voltage conductor (not shown) so that a high voltage electrical circuit is formed through fuse 12. Fuse 12 may be of any conventional power fuse design such as an expulsion fuse which produces exhaust gases upon operation of the fuse to interrupt current flow through the fuse. For example, U.S. Pat. No. 3,719,912 - Harner et al., describes one type of fuse in connection with which the present invention could be used.

Figure 2:
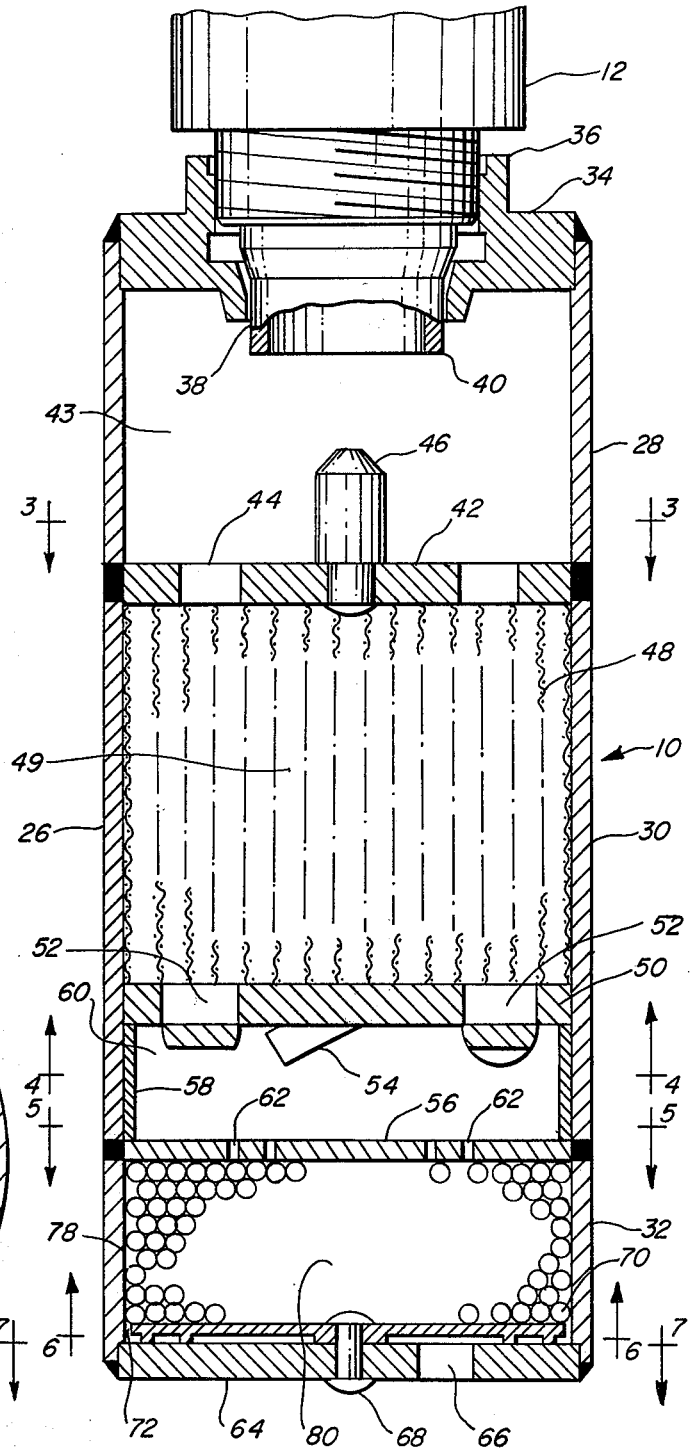
FIG. 2 is a cross sectional view of one embodiment of the present invention.

With reference to FIG. 2, exhaust control device 10 comprises cylindrical housing 26 formed of three cylindrical sections 28, 30, and 32. Welded to one end of cylindrical section 28 is annular mounting ferrule 34 which has a threaded flange 36 that engages the threaded portion of the base of fuse 12. Formed through annular mounting ferrule 34 is intake port 38 through which extends hollow base extension 40 of fuse 12. When fuse 12 operates to interrupt current flow, hot exhaust gases are expelled through hollow base extension 40 into exhaust control device 10.

Figure 3:
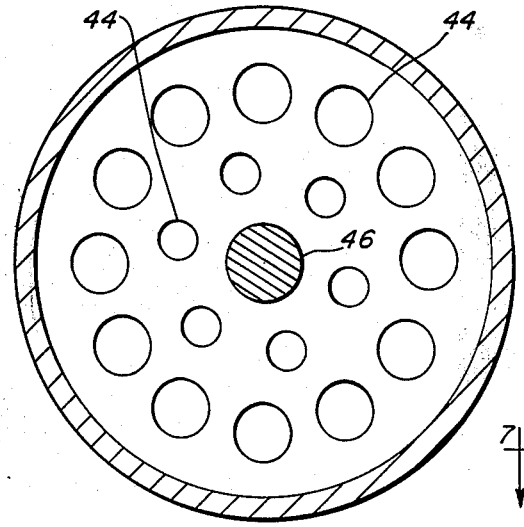
FIG. 3 is a cross sectional view taken substantially along line 3—3 in FIG. 2.

A baffle plate 42 is welded between cylindrical section 28 and cylindrical section 30 of cylindrical housing 26. Baffle plate 42 has circular openings 44 formed therethrough equally spaced around two separate radii (see FIG. 3). Mounted at the center of baffle plate 42 is arcing tip 46 which serves as a point upon which an electrical arc blown into exhaust control device 10 by the exhaust gases can settle. Without arcing tip 46, the electrical arc could settle on the interior of housing 26 and burn a hole through the side of housing 26 resulting in component failure.

Positioned within heat sink chamber 49 defined by baffle plate 42, vortex-producing baffle 50, and cylindrical section 30 of housing 26 is heat sink 48 which preferably comprises a roll of woven copper mesh. Conveniently, other heating absorbing material can be placed in this region depending on the volume available and the amount of energy that has to be absorbed. Due to the high temperature of the exhaust gases impinging upon heat sink 48 thriugh openings 44, the melting point of the heat sink material is reached in a very short time. Therefore, some of the heat sink material vaporizes and is carried by the gas downstream to be recondensed on cooler parts of the heat sink 48 and then again remelted as the temperature rises further downstream. Substantial energy is absorbed in this manner by the heat sink material causing a substantial reduction in the exhaust gas temperature.

Also positioned within cylindrical section 30 of housing 26 is vortex-producing baffle 50. Formed through and positioned radially about vortex-producing baffle 50 are openings 52. Openings 52 are formed by a punch press operation which lances the openings 52 so that flow directing vanes 54 are angularly disposed with respect to openings 52. The arc gases flowing through openings 52 are diverted by vanes 54 toward the interior of cylindrical portion 30 in the direction of arrow A in FIG. 4A causing circular flow within vortex chamber 60.

Welded between cylindrical section 30 and cylindrical section 32 is baffle plate 56. Cut through baffle plate 56 are rectangular openings 62 (see FIG. 5). Positioned between baffle plate 56 and vortex-producing baffle 50 is annular spacer member 58 that positions vortex baffle 58 away from baffle 56 to form a vortex chamber 60 therebetween.

Welded over the end of cylindrical section 32 is end wall member 64, and cut through end wall member 64 are exhaust ports 66 (see FIG. 7). Rivetted to end wall member 64 by rivet 68 is labyrinth plate 70. Labyrinth plate 70 is dimensioned to have a diameter slightly less than the inside diameter of cylindrical section 32 so that an annular orifice 72 is provided between the edge of labyrinth plate 70 and the inside surface of cylindrical section 32. Formed on the flat surface of labyrinth plate 70 are curved protrusions 74 which form labyrinth channels 76 therebetween. Exhaust gases flowing through annular orifice 72 must travel between curved protrusions 74 through labyrinth channels 76 before escaping through exhaust ports 66. Thus, the curved protrusion 74 creates a maze of labyrinth channels 76 which cause the exhaust gases to repeatedly change direction while flowing through labyrinth channels 76 before reaching exhaust ports 66.

An absorbent chamber 80 is defined between labyrinth plate 70, baffle plate 56, and cylindrical section 30. Absorbent chamber 80 is filled with an absorbent material 78 that may be a variety of ceramic or other materials such as activated alumina, tabular alumina or hydrated alumina which may be capable of cooling the arc gases, absorbing water vapor and metallic vapor. The exhaust gas flowing through absorbent material 78 incurs substantial energy loss by expansion and contraction of the gas flow through the voids and restrictions within the absorbent material 78. Since this expansion and compression process is not reversible thermo-dynamically, a relatively large amount of thermal energy is extracted from the gas. Absorbent material 78 also has a characteristic of absorbing gaseous material within its porous structure thereby tending to effect an additional drop in pressure and temperature. For a more detailed description of the size, shape, and composition of absorbent material 78, attention is directed to U.S. Pat. No. 3,719,912 - Harner et al.

Operation of exhaust control device 10 is as follows. When fuse 12 operates, energy is produced in the form of heat, light, and sound; and hot exhaust gases are expelled through hollow base extension 40 of fuse 12. The arc produced during the operation of fuse 12 may be blown into exhaust control device 10 by the inrush of exhaust gases and this arc tends to settle upon arcing tip 46 thereby preventing damage to housing 26 or baffle plate 42. The quantity of energy produced by the operation of fuse 12 varies with the circuit voltage and magnitude of fault current being interrupted. If fuse 12 utilizes a fusible metallic element to interrupt current, the exhaust gases will contain metallic vapors produced by the fusion of the metallic element.

The hot exhaust gases are initially received in chamber 43 between baffle plate 42 and annular mounting ferrule 44. The hot exhaust gases then travel through circular openings 44 in baffle plate 42 and through heat sink 48 in heat sink chamber 49. Due to the high temperature of the exhaust gases, the melting point of the heat sink material is typically reached in a very short time. Consequently, some of the heat sink material 48 vaporizes and is carried by the exhaust gas downstream to be recondensed on the cooler parts of heat sink 48 and then again remelted as the temperature rises downstream. This process repeats itself repeatedly as the exhaust gas flows through heat sink 48 causing substantial energy to be absorbed from the exhaust gases in the heat sink chamber 49 resulting in substantial temperature drop of the exhaust gases.

The exhaust gases, rich with metallic vapors and carrying molten heat sink material downstream pass through openings 52 in vortex-producing baffle 50. The hot exhaust gases impinge upon flow directing vanes 54 causing the gases to be directed toward the interior surface of vortex chamber 60. Since vortex chamber 69 is cylindrical, a forced circular gas flow results causing the heavy metallic particles and vapors to be deposited and condensed upon the interior surface of vortex chamber 60 by centrifugal force. Further, the diverting of the direction of flow of the exhaust gases absorbs additional energy by momentum energy exchange.

The exhaust gases, now substantially free of most of the metal particles and vapors, and substantially cooled, pass through openings 62 in baffle plate 56. Rectangular openings 62 are arranged toward the center of baffle plate 56 to minimize the transmission of molten metal and metal particles into openings 62 thereby substantially reducing the possibility of clogging of rectangular openings 62. Rectangular openings 62 are also preferably rectangular in shape to prevent clogging by the particles of absorbent material 78 in absorbent chamber 80. Absorbent material 78 may conveniently be pellets of spherical shape but other shapes, regular or irregular in nature may be utilized. The preferred diameter and size of the absorbent material is disclosed in U.S. Pat. No. 3,719,912 - Harner et al.

The absorbent material 78 performs a multiplicity of functions. First, as an additional heat sink, it further cools the exhaust gases. Absorbent material 78 also absorbs some of the water vapor which is a byproduct of the arc extinguishing material typically utilized in fuse 12. Moreover, absorbent material 78 attenuates the sound produced during operation of fuse 12 due to wave concellation and cross flow channeling within absorbent material 78. In addition, absorbent material 78 filters out the remaining metallic or other solid debris which is not deposited on the walls of vortex chamber 60.

The exhaust gases then pass through annular orifice 72 around labyrinth plate 70 and pass through labyrinth channels 76. Further sound attenuation and energy absorption is produced at this stage due to the restriction of the flow of gas and the cancellation and repeated change of direction of gas flow. The exhaust gases then escape through exhaust ports 66 to the atmosphere. At this point, a major portion of the heat, light, and sound energy of the exhaust gases has been dissipated in exhaust control device 10 thereby suppressing and attenuating the discharge of blasts of sound and incandescent gases as a result of the operation of fuse 12.

Figure 8:
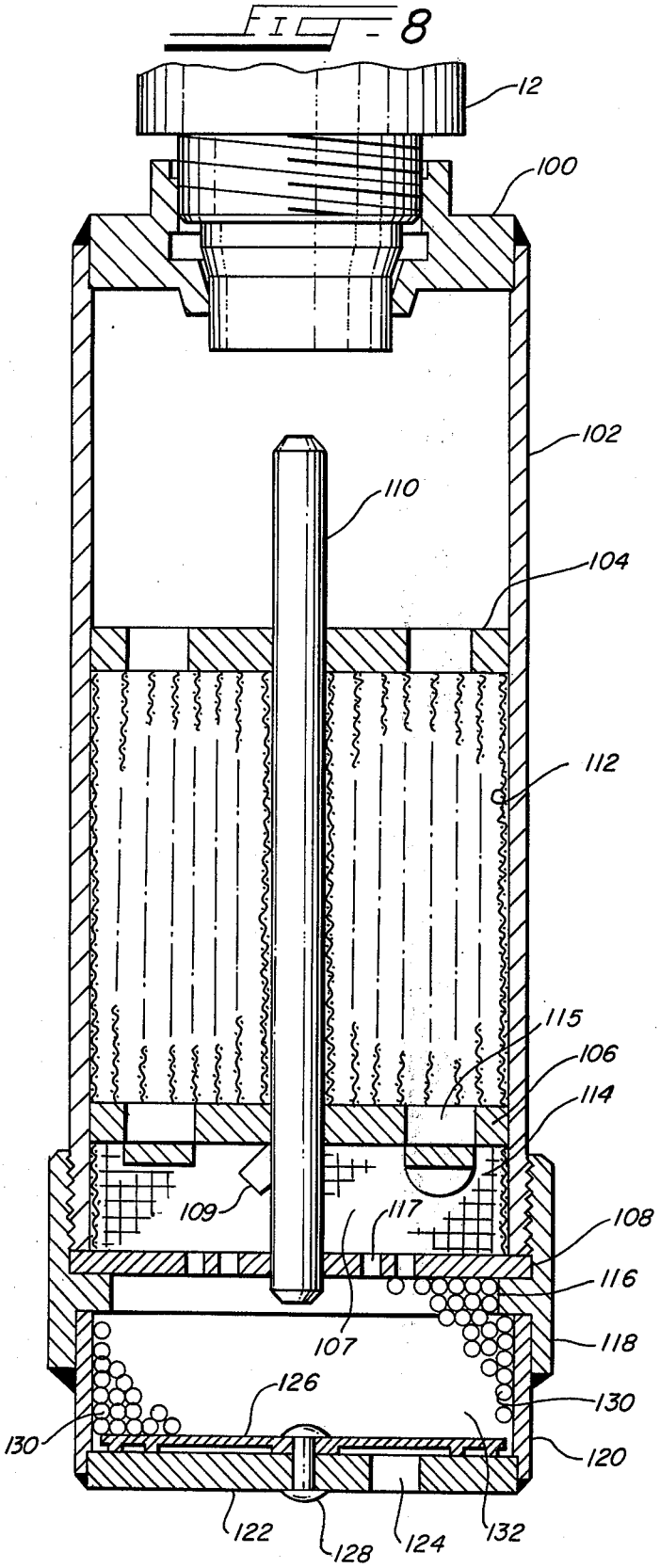
FIG. 8 is a cross sectional view of an alternative embodiment of the present invention.

With reference to FIG. 8, an alternative embodiment of the present invention is illustrated. Annular mounting ferrule 100 is welded to the end of cylindrical housing 102. Annular mounting ferrule 100 is thread mounted to the base of fuse 12 as previously described with respect to the embodiment illustrated in FIG. 2. In the FIG. 8 embodiment, baffle plate 104, vortex-producing baffle 106, and baffle plate 108 are all mounted on an arcing rod 110 and either welded in place or attached by any other suitable means. Heat sink 112 comprising a metallic wire mesh as previously described is positioned around arcing rod 110 between baffle plate 104 and vortex-producing baffle 106.

In this embodiment, an additional deposit screen 114 is positioned between vortex-producing baffle 106 and baffle plate 108 along the interior surface of vortex chamber 107. A flange 116 on threaded sleeve 118 retains baffle plate 108 against the end of cylindrical housing 102 thereby retaining the respective internal parts in the positions shown in FIG. 8.

Inserted within and welded to threaded sleeve 108 is cylindrical portion 120. Welded over the end of cylindrical portion 120 is end wall member 122 having exhaust ports 124 formed therethrough. As in the previous embodiment, a labyrinth plate 126 is attached to end wall member 122 by rivet 128. Absorbent material 130 of the same type previously described is positioned within absorbent chamber 132.

Operation of the FIG. 8 embodiment is substantially the same as that described with respect to the FIG. 2 embodiment. The principal difference between the two embodiments is the utilization of the deposit screen 114 in vortex chamber 107. Deposit screen 114 increases the surface area upon which the metallic vapors and solid debris can be deposited after travelling through openings 107 in vortex panel 106. Thus, the circular flow of gas in vortex chamber 115 caused by the flow directing vanes 109 tends to cause the metal vapors and solid debris to be deposited upon deposit screen 114 before the exhaust gases pass through openings 117 in baffle plate 108.

Figure 9:
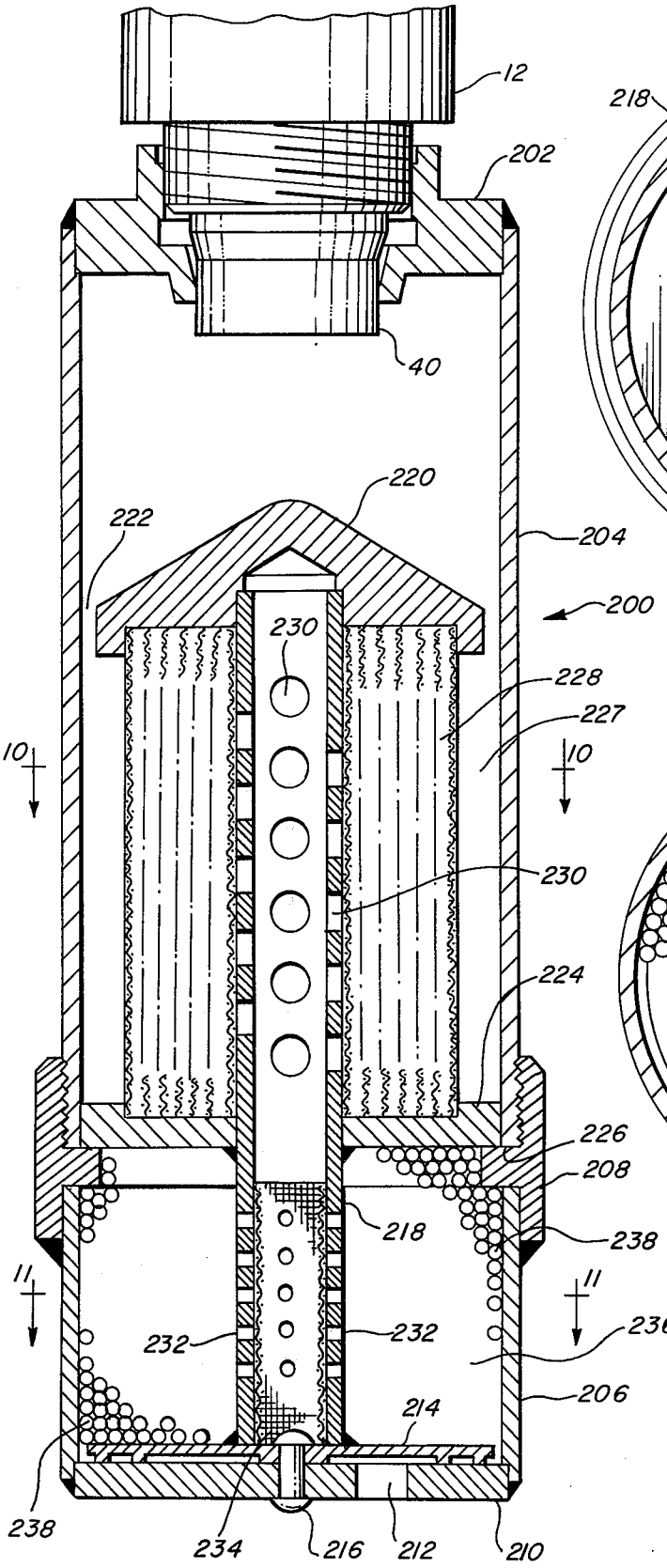
FIG. 9 is a cross sectional view of yet another embodiment of the present invention.
Figure 10:
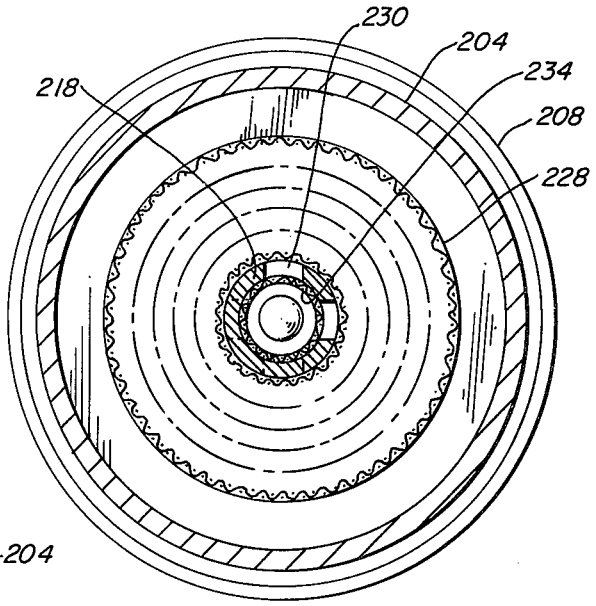
FIG. 10 is a cross sectional view taken substantially along line 10—10 in FIG. 9.
Figure 11:
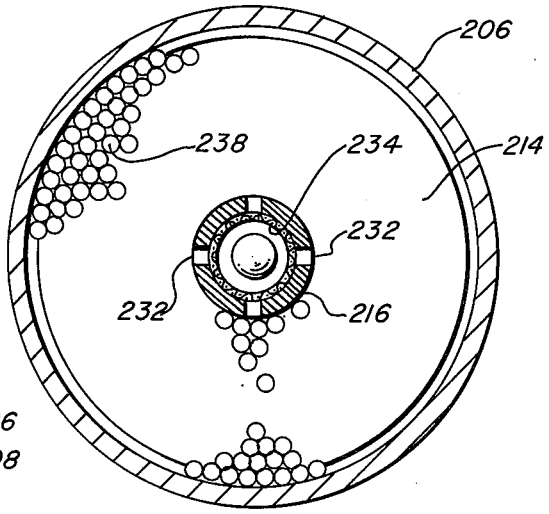
FIG. 11 is a cross sectional view taken substantially along line 11—11 in FIG. 9.

FIGS. 9, 10, and 11 illustrate yet a further embodiment of the present invention. Exhaust control device 200 comprises annular mounting ferrule 202 thread mounted to the base of fuse 12 as previously described. Annular mounting ferrule 202 is welded to the end of cylindrical housing 204. A cylindrical portion 206 is inserted into and welded onto threaded sleeve 208, and threaded sleeve 208 is screwed onto the end of cylindrical housing 204. End wall member 210 having exhaust ports 212 formed therethrough is welded over the end of cylindrical portion 206. A labyrinth plate 214 as previously described is riveted to end wall member 210 by rivet 216. A vortex-producing tube 218 is welded to labyrinth plate 214 and extends approximately along the center axis of cylindrical housing 204.

Mounted at the opposite end of vortex-producing tube 218 is conical baffle member 220 that is dimensioned to have a diameter slightly less than the inside diameter of cylindrical housing 204 so that an annular orifice 222 is formed between the edge of conical baffle 220 and the interior surface of cylindrical housing 204. Also welded to vortex-producing tube 218 is circular plate 224 which is dimensioned to seal against the interior surface of cylindrical housing 204 and against flange 226 on threaded sleeve 208. Positioned in heat sink chamber 227 between conical baffle member 220 and plate 224 and around vortex-producing tube 218 is heat sink 228 preferably formed of rolled wire screen as previously described.

Cut through one end of vortex-producing tube 218 and communicating between the hollow interior of vortex-producing tube 218 and heat sink chamber 227 are inlet openings 230. Cut through the other end of vortex-producing tube 218 and communicating between the hollow interior of vortex-producing tube 218 and absorbent chamber 236 are outlet openings 232. Positioned inside vortex-producing tube 218, adjacent outlet openings 232 is filter screen 234. Positioned within absorbent chamber 236, defined between cylindrical portion 206, plate 224, and labyrinth plate 214 are particles of absorbent material 238 as previously described.

Operation of exhaust control device 200 is substantially similar to the operation of the embodiments previously described. Hot exhaust gases incident to the operation of fuse 12 are blown into exhaust control device 200 through hollow base extension 40 of fuse 12. If an arc is blown into exhaust control device 200, the arc will tend to strike on conical baffle member 220 thereby preventing damage to cylindrical housing 204. The hot exhaust gases then pass through annular orifice 222 into heat sink chamber 227 and through heat sink 228. Heat sink 228 operates in the same manner as previously described to substantially cool the exhaust gases. The exhaust gases then pass through inlet openings 230 in vortex-producing tube 218. Because the exhaust gas will be entering a number of inlet openings 230 simultaneously, a turbulent flow of exhaust gases is created within vortex-producing tube 218 thereby causing the metal vapors and metal particles in the exhaust gases to be deposited on the interior surface of vortex-producing tube 218. Further, because of the turbulent flow and the change of direction of flow of the exhaust gases, considerable energy is absorbed within vortex-producing tube 218 by momentum energy exchange. The exhaust gases then flow through vortex-producing tube 218, through filter screen 234, and through outlet openings 232 into absorbent chamber 236. Filter screen 234 aids in filtering out larger metal particles thereby reducing the possibility of clogging of outlet openings 232.

The exhaust gases then flow through absorbent material 238 which operates in the same manner as previously described to absorb water vapor, metal vapor, attentuate sound and absorb additional energy. The exhaust gases then flow through the labyrinth channels in labyrinth plate 214 as previously described further attenuating sound and absorbing energy before the exhaust gases are exhausted through exhaust ports 212.

Figure 12:
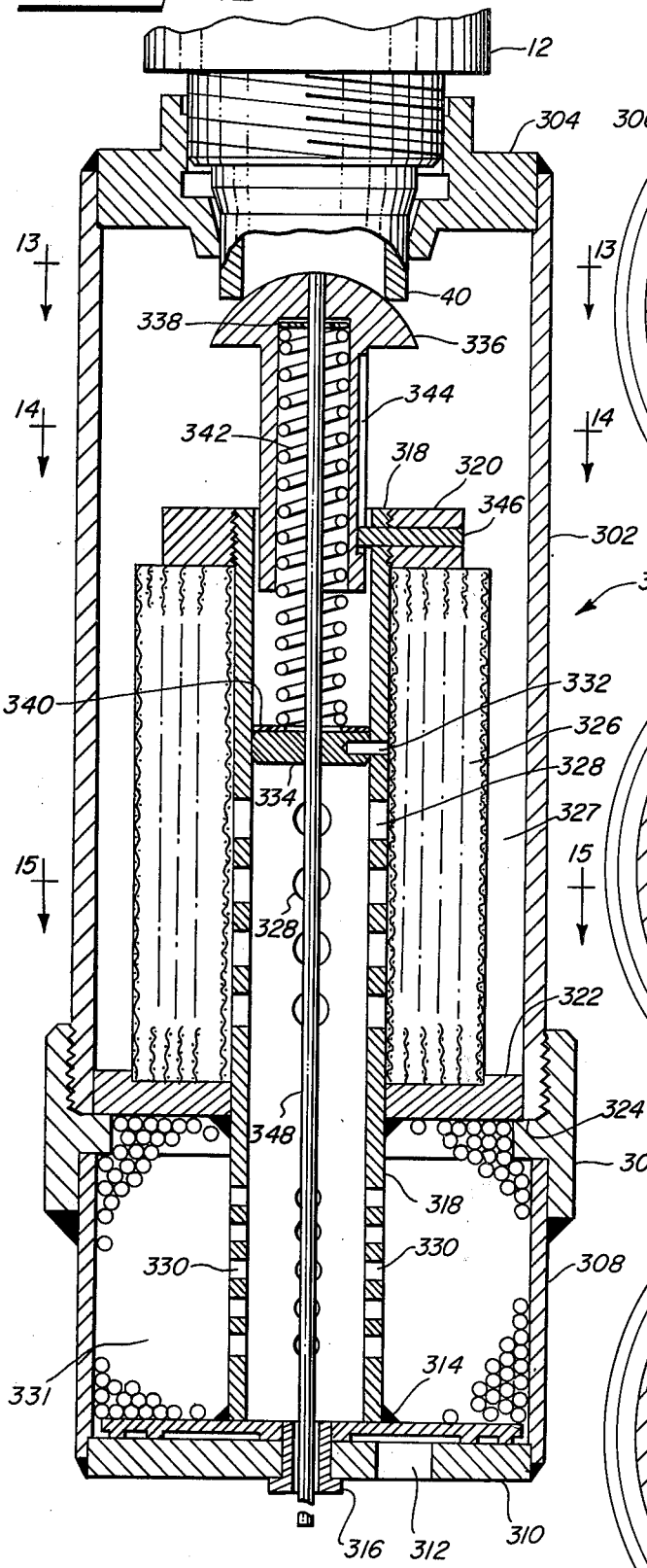
FIG. 12 is a cross sectional view of yet another embodiment of the present invention.
Figure 13:
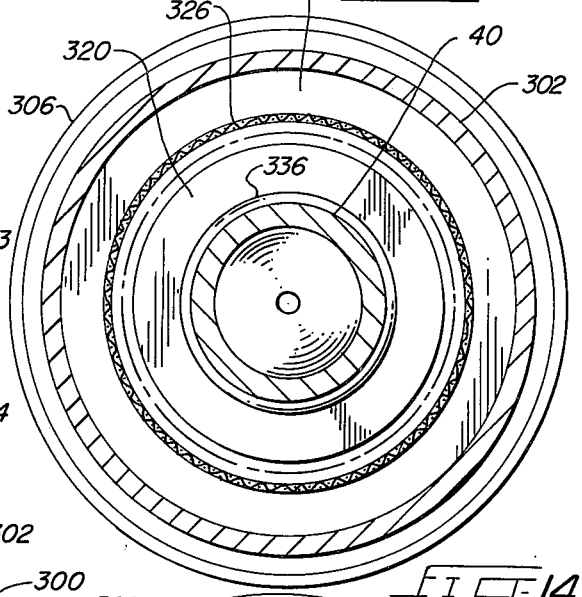
FIG. 13 is a cross sectional view taken substantially along line 13—13 in FIG. 12.
Figure 14:
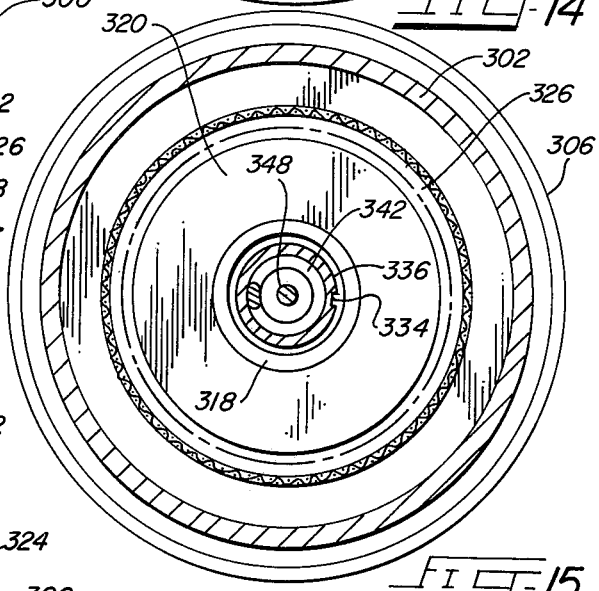
FIG. 14 is a cross sectional view taken substantially along line 14—14 in FIG. 12.
Figure 15:
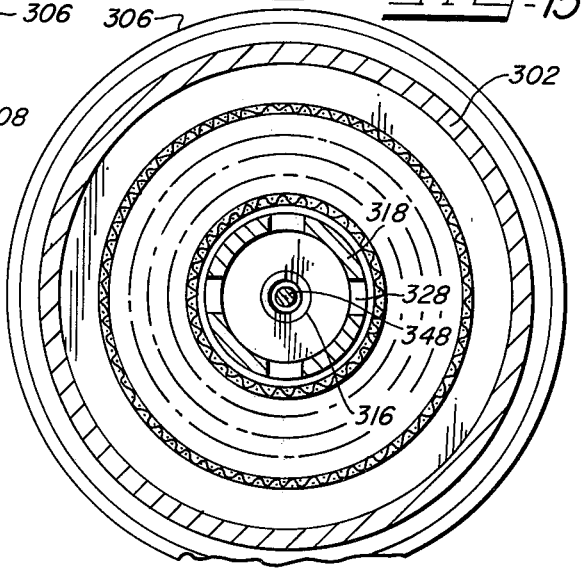
FIG. 15 is a cross sectional view taken substantially along line 15—15 in FIG. 12.

With reference to FIGS. 12, 13, 14 and 14, another alternative embodiment of the present invention is illustrated. Exhaust control device 300 comprises cylindrical housing 302 one end of which is welded to annular mounting ferrule 304. Annular mounting ferrule 304 is thread mounted to the base of fuse 12 as previously described, and hollow base extension 40 of fuse 12 extends into exhaust control device 300. Inserted into and welded to threaded sleeve 306 is cylindrical portion 308. Welded over the end of cylindrical portion 308 is end wall member 310 having exhaust ports 312 formed therethrough. A labyrinth plate 314 is mounted against end wall member 310 and held in position by sleeve 316.

A vortex-producing tube 318 is welded at one end at approximately the center of labyrinth plate 314 and extends along the central axis of exhaust control device 300. Thread mounted to the other end of vortex-producing tube 318 is annular plate 320. Also positioned around and welded between the ends of vortex-producing tube 318 is circular plate 322. Circular plate 322 is dimensioned to seal against the interior surface of cylindrical housing 302 and against flange 324 of threaded sleeve 306.

Heat sink 326 is positioned in heat sink chamber 327 around vortex-producing tube 318 between annular plate 320 and circular plate 322. This embodiment is arranged for radial flow of gases through the heat sink 326 for increased utilization of all portions of heat sink 326. Cut through and communicating between the hollow interior of vortex-producing tube 318 and heat sink chamber 327 are inlet openings 328. Also cut through and communicating between the hollow interior of vortex-producing tube 318 and absorbent chamber 331 are outlet openings 330.

Positioned within vortex-producing tube 318 and held in position with pin 332 is spring stop 334. A check valve plunger 336 is positioned within the hollow interior of the end of vortex-producing tube 318. Check valve plunger 336 has a hollow interior in which is positioned insulating disc 338. An insulating disc 340 is also positioned against spring stop 334. A spring 342 is positioned within the hollow interior of check valve plunger 336 and rests against insulating discs 340 and 348. Spring 342 tends to bias check valve plunger 336 against the hollow base extension 40 of fuse 12. A groove 344 is also provided in the side of check valve plunger 336. A stop pin 346 is mounted through annular plate 320 and vortex-producing tube 318 so that stop pin 346 rides in groove 314 to prevent spring 342 from expelling check valve plunger 346 from the end of vortex-producing tube 318. A rod 348 is mounted at one end through the end of check valve plunger 336 and extends through the center of spring 342 along the axis of device 300. Rod 348 rides in an opening through stop 334 and sleeve 316. Rod 348 may be eliminated without detracting from the operation of exhaust control device 300.

The operation of the embodiment illustrated in FIGS. 12-15 is substantially the same as the operation of the previous embodiments except that check valve plunger 336 operates to prevent the hot exhaust gases from reentering fuse 12 after being received into exhaust control device 300. When fuse 12 operates, and the pressure of the exhaust gases builds up, the pressure overcomes the spring bias exerted by spring 342 causing spring valve plunger 336 to move away from hollow base extension 40 allowing the exhaust gases to enter into exhaust control device 300. Check valve plunger 336 will remain open as long as the gas pressure is sufficient to overcome the spring bias. However, once the current has been interrupted by fuse 12 and the pressure of the exhaust gas subsides, spring 342 will slide check valve plunger 336 back to the position illustrated in FIG. 12 closing off the entrance to extension 40 thereby preventing the exhaust gases received into exhaust control device 300 from flowing back into fuse 12.

Exhaust control device 300 further operates in substantially the same manner as the embodiment illustrated in FIG. 9 to cool and reduce the energy of the hot exhaust gases expelled from fuse 12. Check valve plunger 336 also performs the function of providing a point on which any arc blown into exhaust control device 300 can strike thereby preventing damage to the cylindrical housing 302.

It should be expressly understood that various modifications and changes can be made to the structure of the present invention as ilustrated in the accompanying drawings without departing from the spirit and scope of the present invention as defined in the appended claims. For example, an exhaust control device suitable for less severe duty or less stringent requirements could be fabricated without incorporating an absorbent chamber and absorbent material.

We claim:

1. An exhaust control device for a circuit interrupter comprising:

a hollow housing having an intake means for receiving a stream of hot exhaust gases incident to the operation of the circuit interrupter;

heat sink means for cooling the hot exhaust gases positioned in said housing adjacent to said intake means in the stream of travel of the hot exhaust gases;

vortex-producing means for changing the direction of flow of the hot exhaust gases to achieve a momentum energy exchange to slow the speed of travel of the hot exhaust gases and to deposit and condense molten metal and metal vapor carried by the exhaust gases, said vortex-producing means being positioned downstream of said heat sink means;

absorbent means for further cooling the hot exhaust gases, for absorbing water vapor, for attenuating sound, and for filtering out solid debris, molten metal and metal vapor carried by the exhaust gases, said absorbent means positioned downstream of said vortex-producing means;

restricted outlet means in said housing communicating with said absorbent means for attenuating the production of sound by restricting the flow of exhaust gases from the housing into the atmosphere.

2. An exhaust control device, as claimed in claim 1, wherein said heat sink means comprises a mesh of metallic wire.

3. An exhaust control device, as claimed in claim 1, wherein said heat sink means comprises a mesh of copper wire.

4. An exhaust control device, as claimed in claim 1, wherein said vortex-producing means comprises a baffle having formed therein openings across which angularly disposed vanes arranged to divert the flow of exhaust gases toward the interior surface of said hollow housing so that a circular flow is created causing the molten metal and metal vapor carried by the exhaust gases to be deposited and condensed on the interior surface of said hollow housing.

5. An exhaust control device, as claimed in claim 1, wherein said vortex-producing means comprises a hollow cylindrical tube positioned at approximately the center of the hollow housing having inlet openings formed around the periphery at one end thereof adjacent said heat sink means for receiving the hot arc gases and outlet openings formed around the periphery at the other end thereof adjacent said absorbent means whereby the direction of flow of the exhaust gases is diverted as the exhaust gases flow through said tube causing a turbulent flow of the exhaust gases thereby absorbing energy from the exhaust gases and depositing and condensing molten metal and metal vapors carried by the exhaust gases.

6. An exhaust control device, as claimed in claim 1, wherein said absorbent means comprises a chamber within said housing filled with particles of water and metal vapor absorbent material.

7. An exhaust control device, as claimed in claim 6, wherein said solid absorbent material is selected from the class consisting of activated alumina, tubular alumina, and hydrated alumina.

8. An exhaust control device, as claimed in claim 1, wherein said restricted outlet means comprises labyrinth means including a plate having formed thereon a maze of gas flow diverting channels for repeatedly changing the direction of flow of the exhaust gases, and an end wall member having exhaust ports formed therethrough communicating with said flow diverting channels.

9. An exhaust control device, as claimed in claim 1, further comprising check valve means for preventing the hot exhaust gases from re-entering the circuit interrupter after the exhaust gases are received by the exhaust control device.

10. An exhaust control device, as claimed in claim 9, wherein said check valve means comprises a spring biased member that normally closes said intake means in the hollow housing and that opens to allow entry of the exhaust gases when the pressure of the exhaust gases is sufficient to overcome the spring bias and that closes to retain the exhaust gases in the exhaust control device when the pressure of the arc gases is insufficient to overcome the spring bias.

11. An exhaust control device for a circuit interrupter comprising:

a hollow housing having an intake port for receiving hot exhaust gases incident to the operation of the circuit interrupter;

a first baffle plate positioned within said hollow housing adjacent the intake port defining a first chamber for receiving the exhaust gases, said first baffle having holes therethrough for passing the exhaust gases;

a second baffle plate positioned within said hollow housing defining between said first baffle plate and said second baffle plate a second chamber, said second baffle plate having holes therethrough for passing the exhaust gases;

heat sink means positioned within said second chamber for cooling the exhaust gases;

a third baffle plate positioned within said housing defining between said second baffle plate and said third baffle plate a third chamber, said third baffle plate having openings therethrough for passing the exhaust gases;

flow diverting vanes formed across the holes in said second baffle plate for diverting the flow of exhaust gases toward the interior surface of said housing within said third chamber;

an end wall of said housing, said end wall including restricted outlet means for attenuating the production of sound by restricting the flow of exhaust gases from the housing into the atmosphere, said end wall and said third baffle defining a fourth chamber therebetween said fourth chamber being filled with particles of water and metal vapor absorbent material.

12. An exhaust control device, as claimed in claim 11, wherein said restricted outlet means comprises a labyrinth plate having formed thereon a maze of labyrinth channels for repeatedly changing the direction of flow of the exhaust gases.

13. An exhaust control device, as claimed in claim 11, wherein said heat sink means comprises a mesh of metallic wire.

14. An exhaust control device, as claimed in claim 11, wherein said metallic wire is copper wire.

15. An exhaust control device, as claimed in claim 11, wherein said water and metal absorbent material is selected from a class consisting of activated alumina, tabular alumina, and hydrated alumina.

16. An exhaust control device for a circuit interruptor comprising: a hollow cylindrical housing having an intake port at one end thereof for receiving hot exhaust gases incident to the operation of the circuit interrupter, said housing having an end wall at the other end thereof with exhaust ports formed therethrough for exhausting gases to the atmosphere;

a first baffle plate positioned within said housing defining a first chamber for receiving the exhaust gases, said first baffle plate having an annular orifice around the periphery thereof for passing the exhaust gases;

a hollow tube positioned at approximately the center of the housing supporting the first baffle plate on one end thereof, said hollow tube having gas inlet openings through said tube at the end thereof adjacent said first baffle plate, and having gas outlet openings through said tube at the other end of said tube;

a second baffle plate positioned around said tube in said housing sealing against said tube and against the interior of said housing so that the exhaust gases will flow through said tube from said inlet openings to said outlet openings;

a mesh of metallic wire positioned around said tube between said first and second baffle plates adjacent to said inlet opening, said mesh of metallic wire capable of cooling the exhaust gases;

restricted outlet means positioned against said end wall, said restricted outlet means and said second bafffle plate defining a second chamber therebetween, said second chamber being filled with particles of water and metal vapor absorbent material and said restricted outlet means for attenuating production of sound by restricting the flow of exhaust gases from the housing into the atmosphere.

17. An exhaust control device, as claimed in claim 16, wherein said restricted outlet means comprises a labyrinth plate having formed thereon a maze of labyrinth channels for repeatedly changing the direction of flow of the exhaust gases, said labyrinth channels communicating between said second chamber and the exhaust ports.

18. An exhaust control device, as claimed in claim 16, wherein said mesh of metallic wire is copper wire.

19. An exhaust control device, as claimed in claim 16, wherein said gas and metal vapor absorbent material is selected from a class consisting of activated alumina, tabular alumina, and hydrated alumina.

20. An exhaust control device, as claimed in claim 16, further comprising a check valve means for preventing the hot exhaust gases from re-entering the circuit interrupter after the exhaust gases are received by the exhaust control device.

21. An exhaust control device, as claimed in claim 20, wherein said check valve means comprises a spring biased member that normally closes said intake port in said housing and that opens to allow entry of the exhaust gases when the pressure of the exhaust gases is sufficient to overcome the spring bias, and that closes to retain the exhaust gases in the exhaust control device when the pressure of the arc gases is insufficient to overcome the spring bias.

22. An exhaust control device for a circuit interrupter comprising:

a hollow housing having an intake means for receiving a stream of hot exhaust gases incident to the operation of the circuit interrupter;

heat sink means for cooling the hot exhaust gases positioned in said housing adjacent to said intake means in the stream of travel of the hot exhaust gases;

vortex-producing means for changing the direction of flow of the hot exhaust gases to achieve a momentum energy exchange to slow the speed of travel of the hot exhaust gases and to deposit and condense molten metal and metal vapor carried by the exhaust gases, said vortex-producing means being positioned downstream of said heat sink means;

restricted outlet means in said housing communicating with said vortex-producing means for alternating the production of sound by restricting the flow of exhaust gases from the housing into the atmosphere.

23. An exhaust control device for a circuit interrupter comprising:

a hollow housing having an intake means for receiving a stream of hot exhaust gases incident to the operation of the circuit interrupter;

heat sink means for cooling the hot exhaust gases positioned in said housing adjacent to said intake means in the stream of travel of the hot exhaust gases;

turbulence-producing means positioned downstream of said heat sink means, for producing turbulent flow of the hot exhaust gases so that the flow of hot exhaust gases is slowed thereby causing the separation and precipitation of molten metal and metal vapor carried by the exhaust gases;

absorbent means for further cooling the hot exhaust gases, for absorbing water vapor, for attenuating sound, and for filtering out solid debris, molten metal and metal vapor carried by the exhaust gases, said absorbent means positioned downstream of said turbulence-producing means;

restricted outlet means in said housing communicating with said absorbent means for attenuating the production of sound by restricting the flow of exhaust gases from the housing into the atmosphere.

* * * * *